US005947350A

United States Patent [19]

Crepps

[11] Patent Number: 5,947,350

[45] Date of Patent: Sep. 7, 1999

[54] CONTAINER-HOLDING DEVICE

[76] Inventor: William R. Crepps, 151 Bare St., Cox's Creek, Ky. 40013

[21] Appl. No.: 08/834,897

[22] Filed: Apr. 7, 1997

[51] Int. Cl.[6] ..... A47K 1/08

[52] U.S. Cl. ..... 224/148.4; 224/401; 224/561; 224/926

[58] Field of Search ..... 224/148.4, 148.7, 224/926, 0.5, 401, 561; 54/44.1; 248/311.2

[56] References Cited

U.S. PATENT DOCUMENTS

| | | | |
|---|---|---|---|
| 3,268,133 | 8/1966 | McAnallen | 224/561 X |
| 3,457,702 | 7/1969 | Brown . | |
| 4,191,350 | 3/1980 | Ormond . | |
| 4,629,153 | 12/1986 | Marcum | 224/926 |
| 4,819,843 | 4/1989 | Nakayama | 224/926 |
| 4,915,337 | 4/1990 | Iwasaki . | |
| 5,295,650 | 3/1994 | Brandt | 248/311.2 |
| 5,511,754 | 4/1996 | Johannsen . | |
| 5,639,052 | 6/1997 | Suave | 224/926 |

*Primary Examiner*—Renee S. Luebke
*Attorney, Agent, or Firm*—Middleton & Reutlinger; John F. Salazar

[57] ABSTRACT

A container-holding device removably attached to an external, rigid support, such as a riding saddle for a horse, wherein the container-holding device prevents spillage of a container held therein in the event that the external, rigid support experiences sudden and substantial movement. The container-holding device is provided with a retaining ring and a plurality of flexible support members extending downwardly therefrom. A base member is attached to the flexible support members at flexible support member ends opposite the retaining ring.

1 Claim, 10 Drawing Sheets

CONTAINER-HOLDING DEVICE

BACKGROUND OF THE INVENTION

1. Technical Field of the Invention

The present invention relates to a container-holding device. More particularly, the present invention relates to a container-holding device which is removably attached to an external, rigid support.

2. Discussion of the Prior Art

The use of an external device to hold a liquid-filled container, thereby freeing the user from the obligation of holding the container, is desired in a variety of situations. For example, U.S. Pat. No. 4,191,350 to Ormond teaches a container-holding device designed preferably for use on a boat or mobile home, and U.S. Pat. No. 5,295,650 to Brandt teaches a similar device designed preferably for attachment to the arm of a lounge chair. Further, U.S. Pat. No. 4,819,843 to Nakayama teaches an adjustable drink container holder specifically designed to maintain an upright position of the container, regardless of the particular orientation of the rigid support to which it is attached.

However, none of these references are directed to a container-holding device capable of preventing spillage of a container held therein when the rigid support experiences sudden and substantial movement, as when the container-holding device is attached to a saddle horn mounted on a horse.

SUMMARY OF THE INVENTION

It is an object of the present invention to provide a container-holding device for use in combination with a riding saddle mounted on a horse.

It is another object of the present invention to provide a container-holding device which prevents spillage of a container held therein in the event that the container-holding device is subjected to sudden and substantial movement by absorbing a portion of this movement instead of transferring all of such movement to the container.

More particularly, the present invention provides a container-holding device comprising a handle, a retaining ring, a base and a plurality of flexible support members, wherein the retaining ring is attached at an outer surface thereof to a first distal end of the handle and a second distal end of the handle includes a concave surface and a roughened portion thereon to frictionally engage an exterior surface of the riding saddle.

The retaining ring, the flexible support members and the base cooperate to define a cup-shaped receiving pocket, into which the container is inserted and allowed to rest upon an upper surface of the base. When the container-holding device is subjected to sudden and substantial movement, a portion of such movement is absorbed by the retaining ring and the handle independently from the base and the container which rests thereon. The container-holding device reduces the amount of sudden and substantial movement transferred to the container, thereby preventing the container from spilling.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
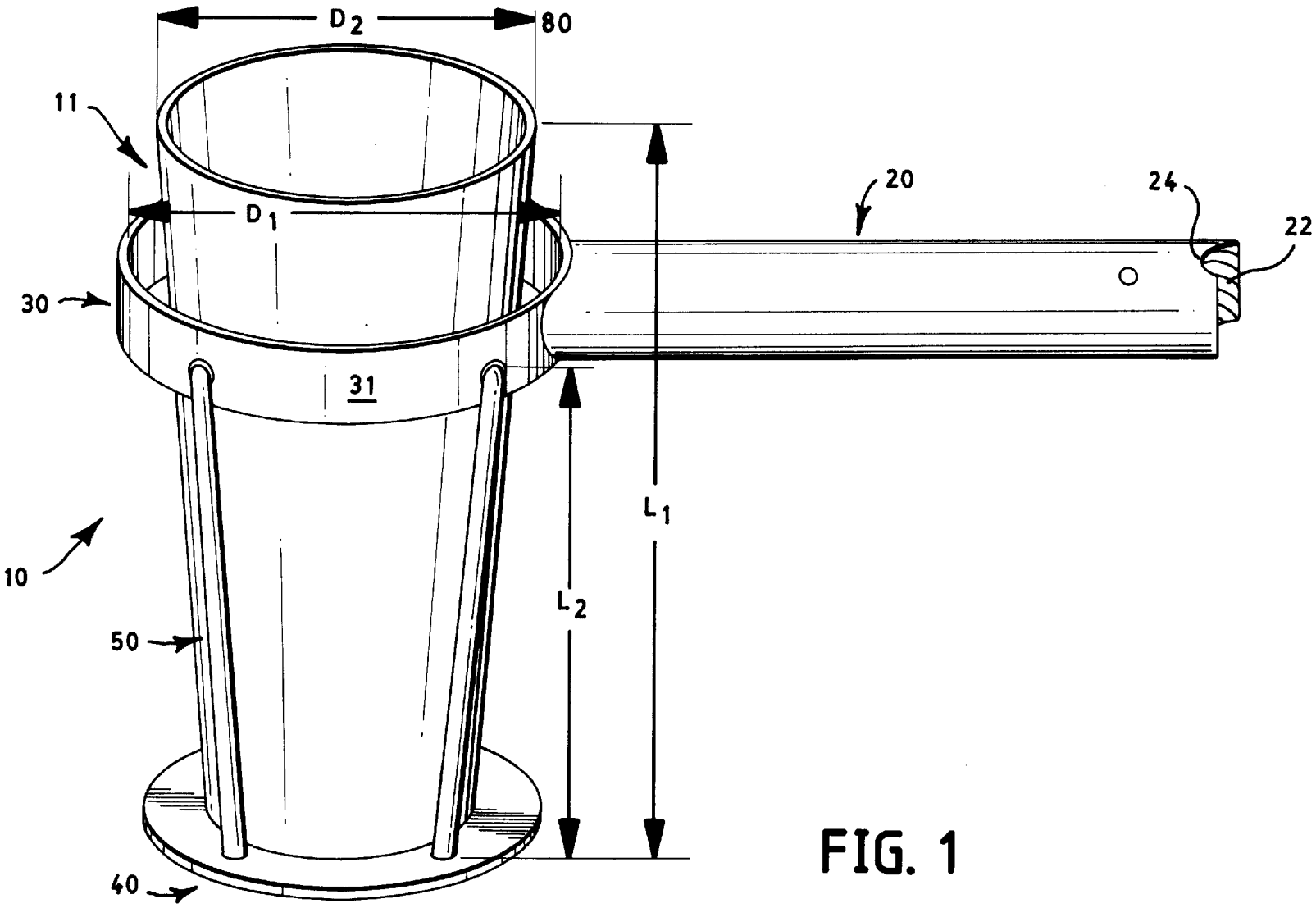
FIG. 1 is a perspective view of a container-holding device of the present invention with a typical container therein.

With reference to FIG. 1, a container-holding device 10 for use in combination with a riding saddle 12 (FIG. 5) is shown with a container 11 held therein. The container-holding device includes a handle 20, a retaining ring 30, a base 40, and a plurality of flexible support members 50. In a preferred embodiment of the present invention, the container-holding device handle 20 is cylindrical, the base 40 is circular and there are four flexible support members, shown by example as reference numeral 50. The retaining ring 30, the flexible support members 50 and the base 40 cooperate to define a cup-shaped receiving pocket 60 (FIG. 2), into which the container 11 is inserted and allowed to rest upon an upper surface 42 of the base 40. When the container-holding device 10 is subjected to sudden and substantial movement, a portion of such movement is absorbed by the retaining ring 30 and the handle 20 independently from the base 40 and the container 11 which rests thereon. The container-holding device 10 reduces the amount of sudden and substantial movement transferred to the container 11, thereby preventing the container 11 from spilling.

Figure 2:
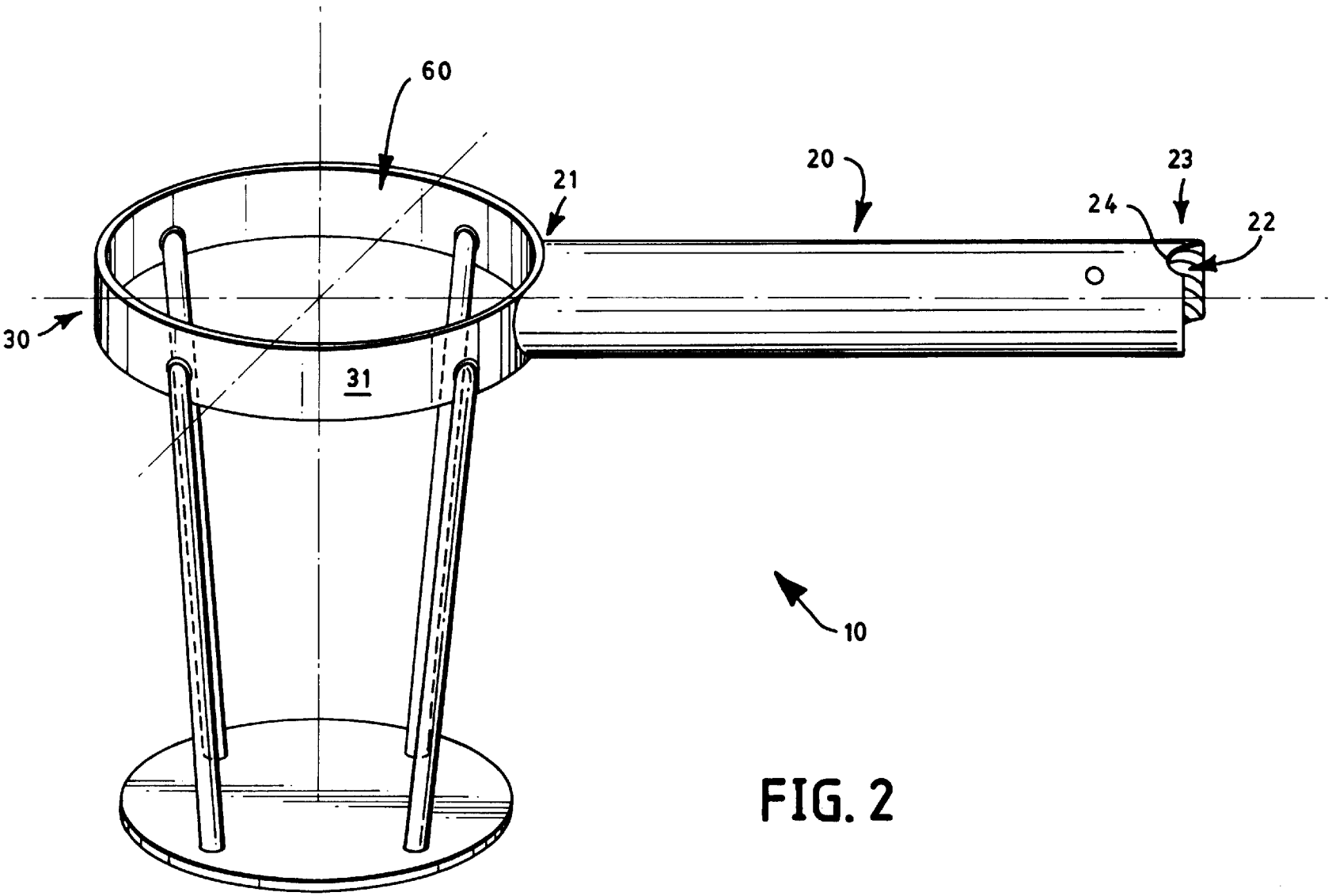
FIG. 2 is a perspective view of the container-holding device of FIG. 1.

With reference to FIG. 2, a container-holding device 10 according to the preferred embodiment of the present invention is shown. The handle 20 includes a first distal end 21 attached to an outer surface 31 of the retaining ring 30 and oriented thereto such that the central longitudinal axis of the handle 20 extends perpendicularly outwardly from the outer surface 31 of the retaining ring 30. The handle 20 may be constructed from any sufficiently rigid material, such as, for example, plastic, metal or wood. Further, the retaining ring 20 is constructed from any sufficiently rigid, light-weight material, such as, for example, plastic or metal. Any suitable means of attaching the handle 20 to the outer surface 31 of the retaining ring 30 may be used, such as by using an appropriate adhesive or by mechanically attachment with a screw, and the particular means employed therefor will be determined by the specific materials chosen for the handle 20 and for the retaining ring 30.

In the preferred embodiment, the handle 20 and the retaining ring 30 are both constructed from wood, and a screw 100 or other similar mechanical attachment(FIG. 4) means is inserted outwardly through the retaining ring 30, is embedded into the first distal end 21 of the handle 20 and is tightened to provide a sufficient frictional engagement between the first distal end 21 of the handle 20 and the outer surface 31 of the retaining ring 30. In such an embodiment, the handle 20 is permitted to rotate nominally relative to the retaining ring 30, thereby permitting the user to adjust the horizontal orientation of the container-holding device 10 to conform the particular shape and orientation of his riding saddle 12 (FIG. 5).

Figure 5:
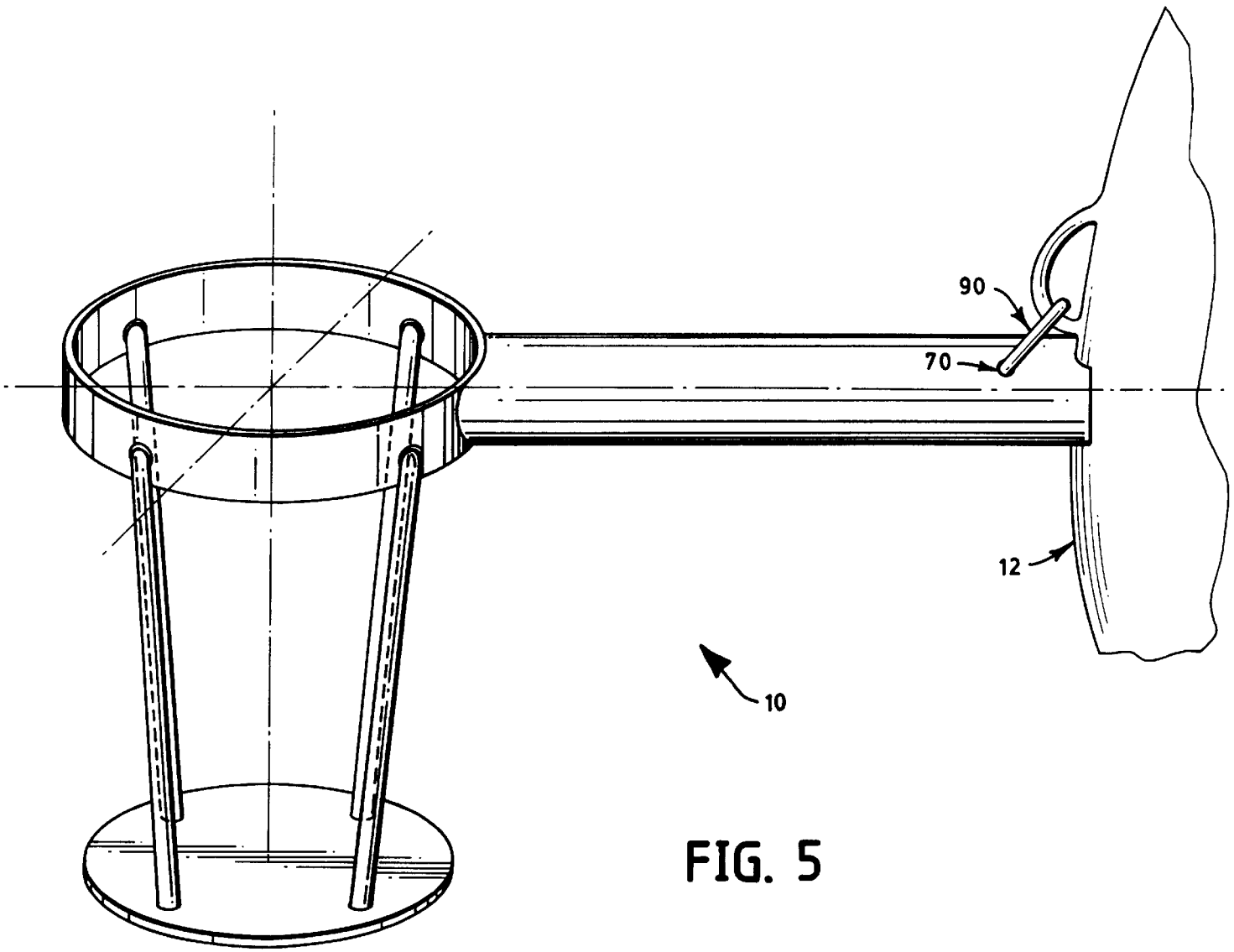

The handle 20 includes a concave surface 24 at a second distal end 23 thereof opposite the first distal end 21, the second distal end 23 being shaped to conform to the size, shape and geometry of a typical riding saddle 12, as shown in FIG. 5. A roughened portion 22 is provided on the concave surface 24 to enhance frictional engagement of the container-holding device 10 to the riding saddle 12, as shown in FIG. 5.

Figure 3:
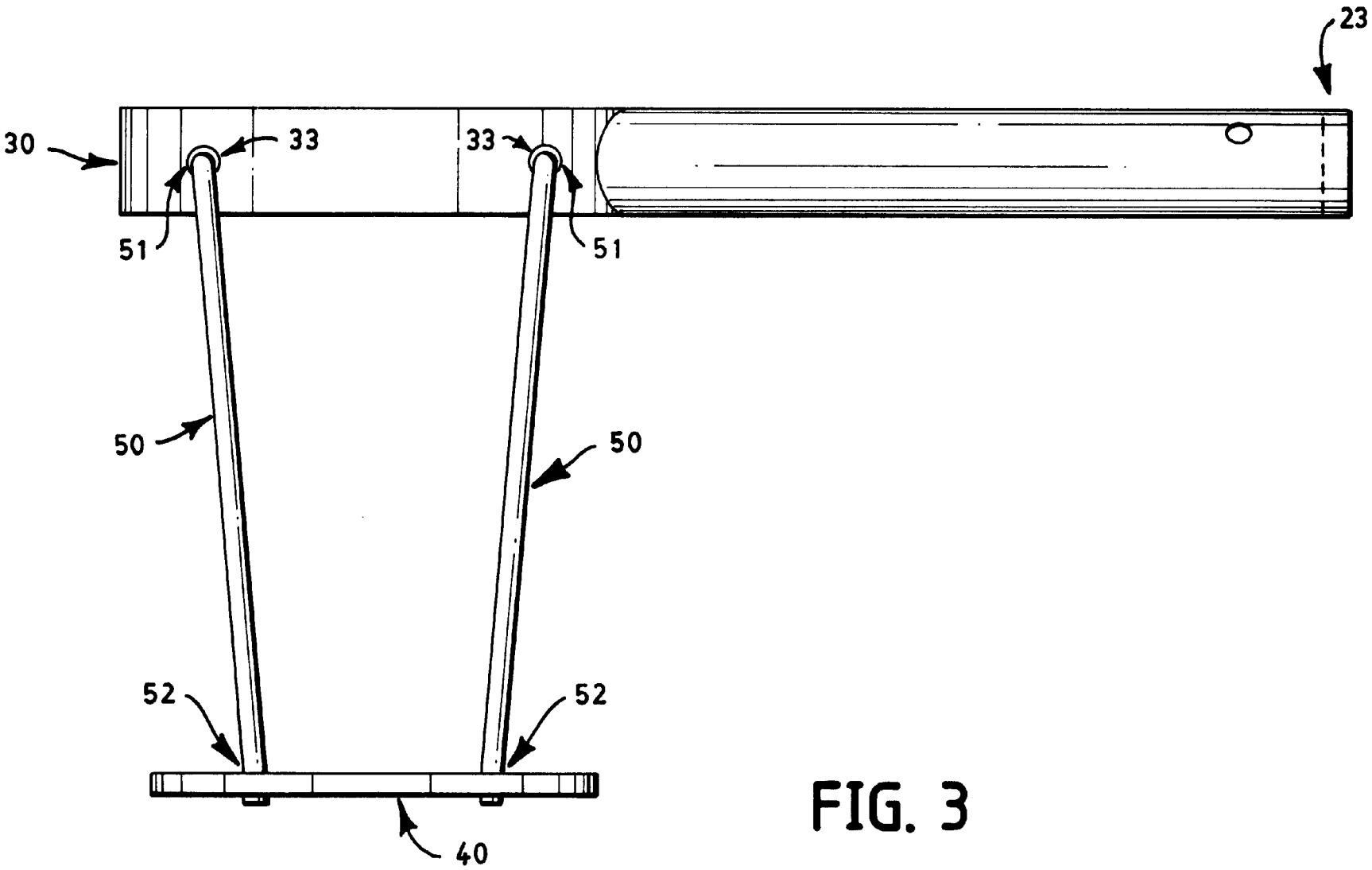
FIG. 3 is a side elevation view of the container-holding device of FIG. 1.
Figure 4:
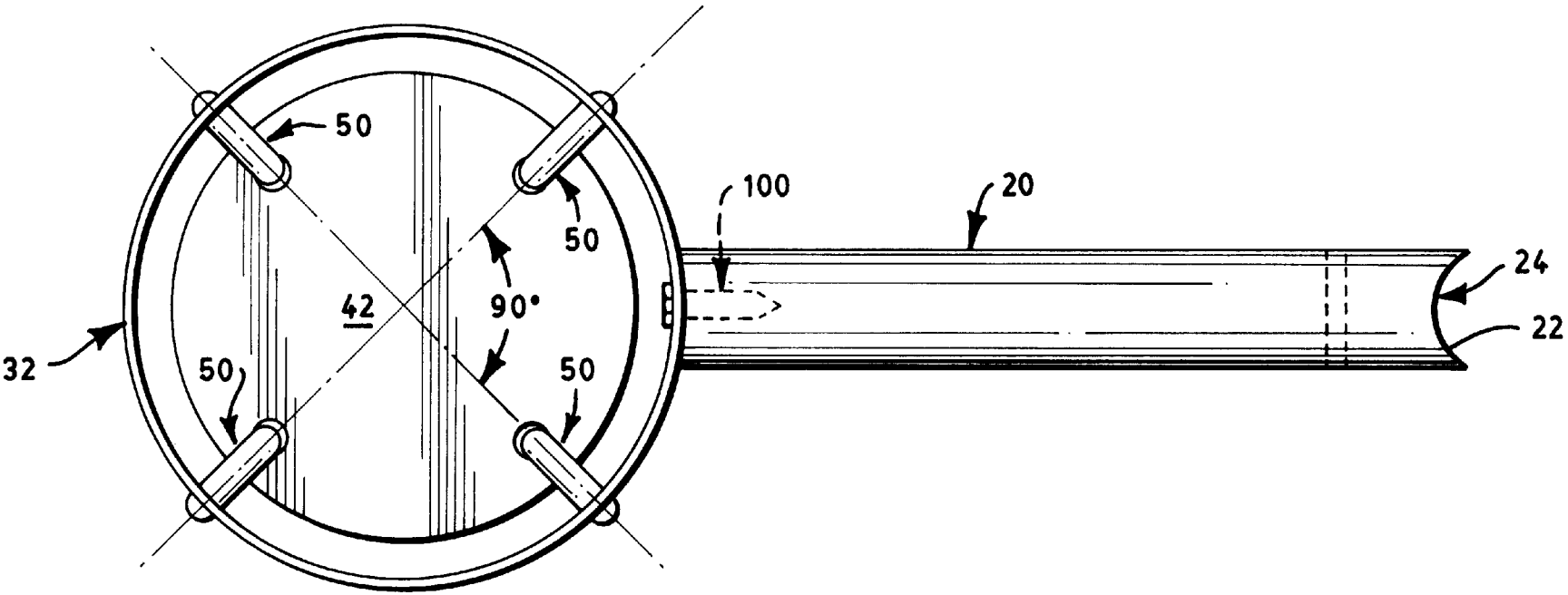
FIG. 4 is a top plan view of a container-holding device of FIG. 1.

With combined reference to FIGS. 3 and 4, flexible support members 50 depend downwardly from the retaining ring 30 and are spaced around the outer perimeter 32 thereof from one another through an arcuate distance of about 90°, as shown in FIG. 4. The flexible support members 50 are constructed from any sufficiently flexible strap material, such as, for example, leather or rope. Any suitable means of attaching the flexible support members 50 to the retaining ring 30 may be used.

Figure 3A:
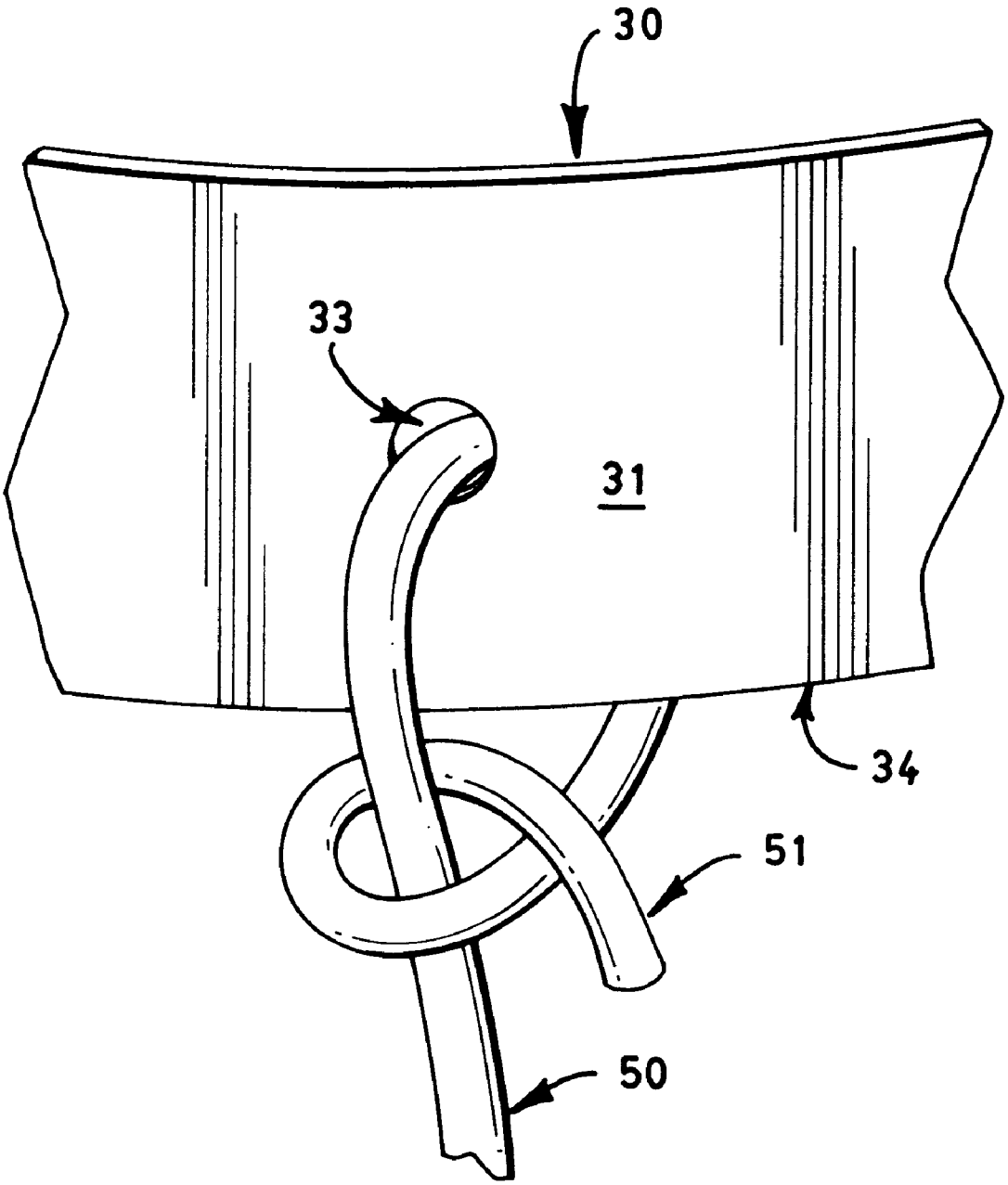
FIG. 3*a* is an enlarged perspective view of one element of FIG. 3 showing a preferred means of attaching flexible support members to a retaining ring according to a preferred embodiment of the present invention.
Figure 3B:
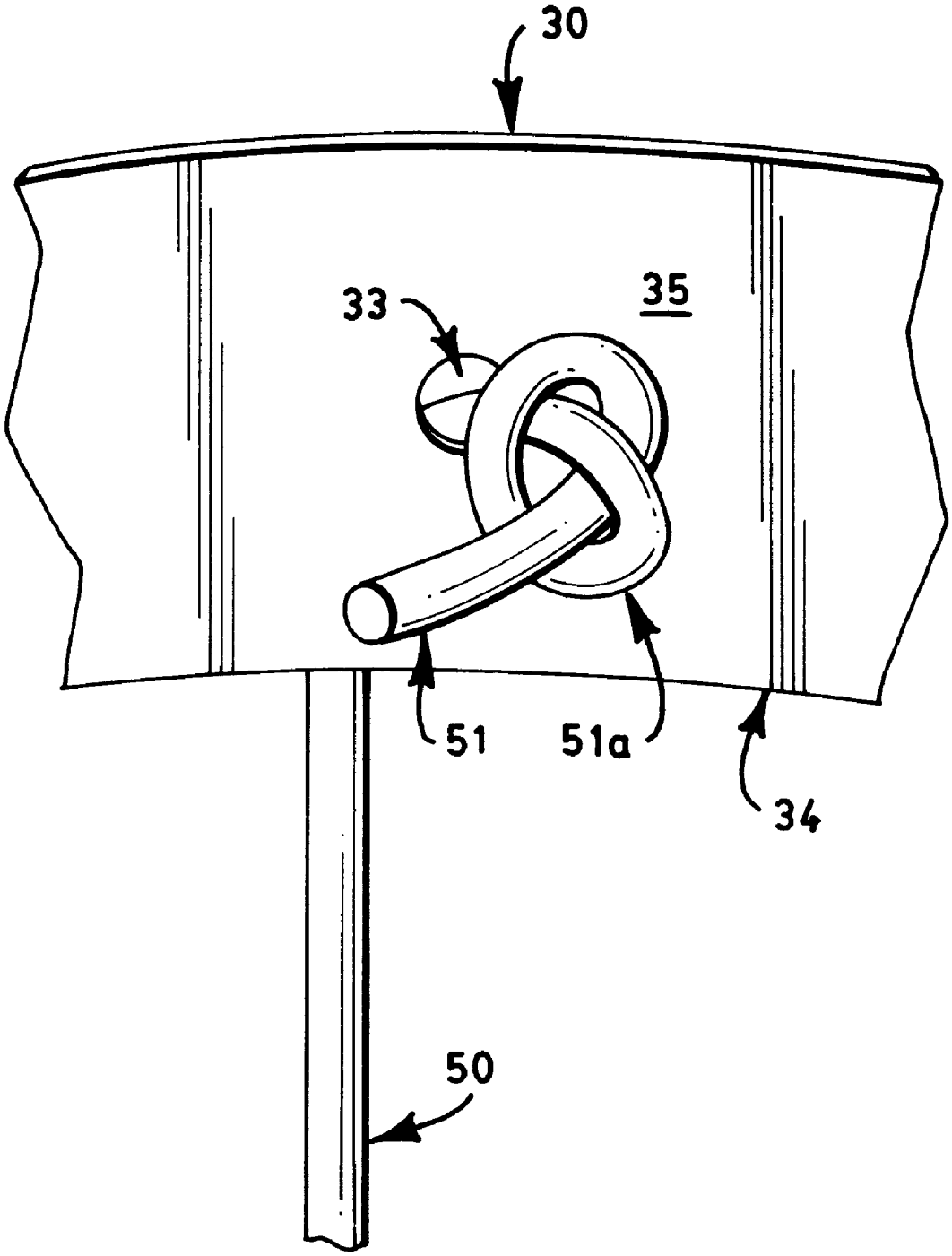
FIG. 3*b* is an enlarged perspective view of an alternative means of FIG. 3*a* for attaching flexible support members to a retaining ring according to the present invention.
Figure 3C:
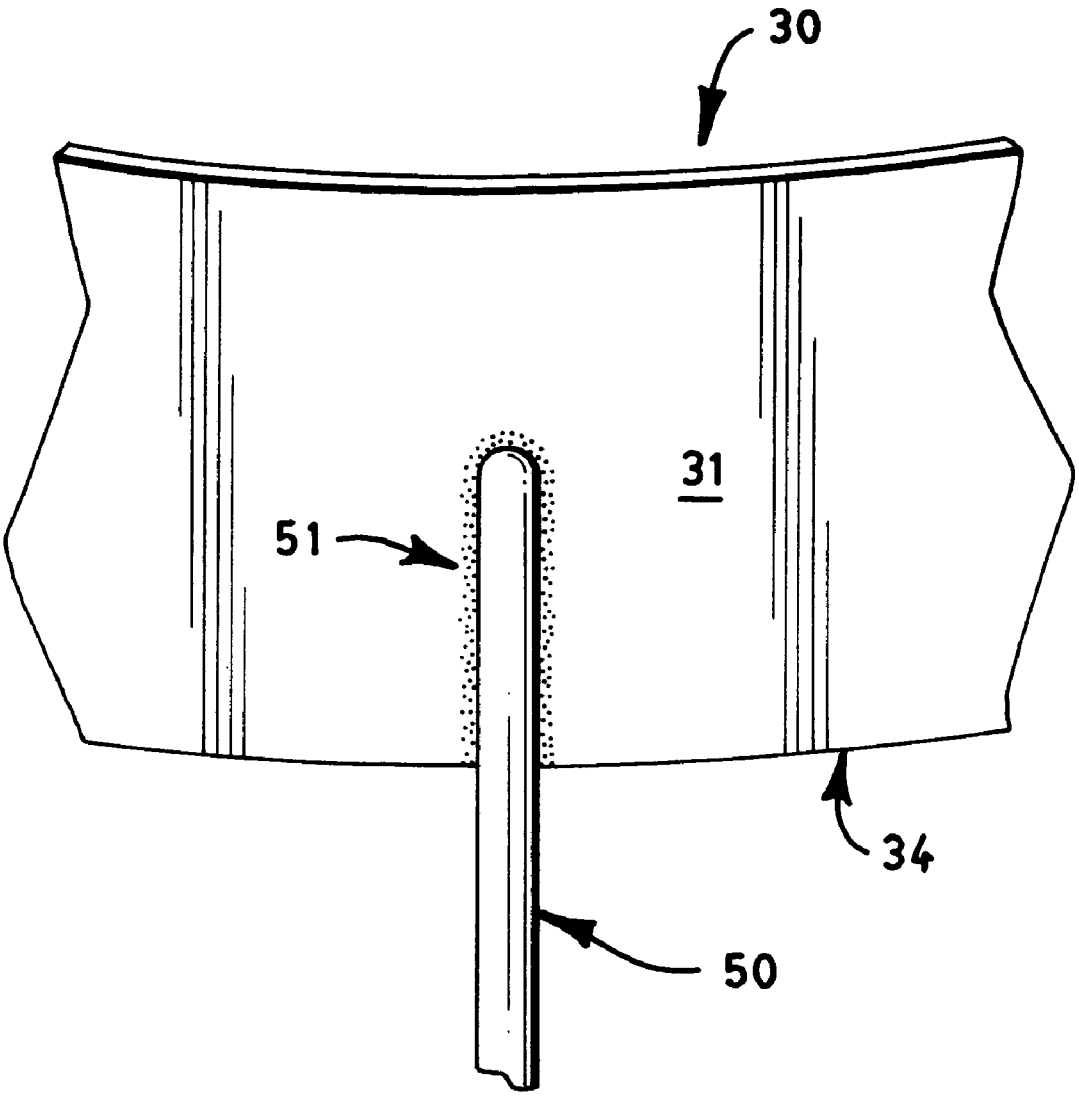
FIG. 3*c* is an enlarged perspective view of another alternative means of FIG. 3*a* for attaching flexible support members to a retaining ring according to the present invention.

With additional reference to FIG. 3*a,* a preferred means of attaching the flexible support members 50 to the retaining ring 30 is shown. According to this embodiment, a small hole 33 is provided at a location towards a lower edge 34 of the retaining ring 30 to receive a flexible support member 50 therethrough. A first distal end 51 of each flexible support member 50 is inserted through its respective receiving hole 33, looped downwardly around the lower edge 34 of the retaining ring 30 and tied to a portion of itself opposite the receiving hole 33. Alternatively, as shown in FIG. 3*b,* the first distal end 51 of each flexible support member 50 may be inserted through its respective receiving hole 33 and tied into a knot 51*a* entirely adjacent to an interior surface 35 of the retaining ring 30. The knot 51*a* is sized larger than the hole 33 to prevent the first distal end 51 from sliding back through its respective hole 33. In another alternative embodiment shown in FIG. 3*c,* the first distal end 51 of each flexible support member 50 may be adhered, such as, for example, by glue or other suitable adhesive, to the retaining ring 30, on either the outer surface 31 thereof or on the inner surface 35 thereof.

With reference to FIG. 3, the base 40 is shown suspended beneath the retaining ring 30 by attaching a second distal end 52 of each flexible support member 50 thereto. Any suitable means of attaching the flexible support members 50 to the base 40 may be used, such as, by means similar to the means used to attach the flexible support members 50 to the retaining ring 30. The base 40 is constructed from any sufficiently rigid material, such as, for example, metal, wood, plastic or hardened leather.

Figure 4A:
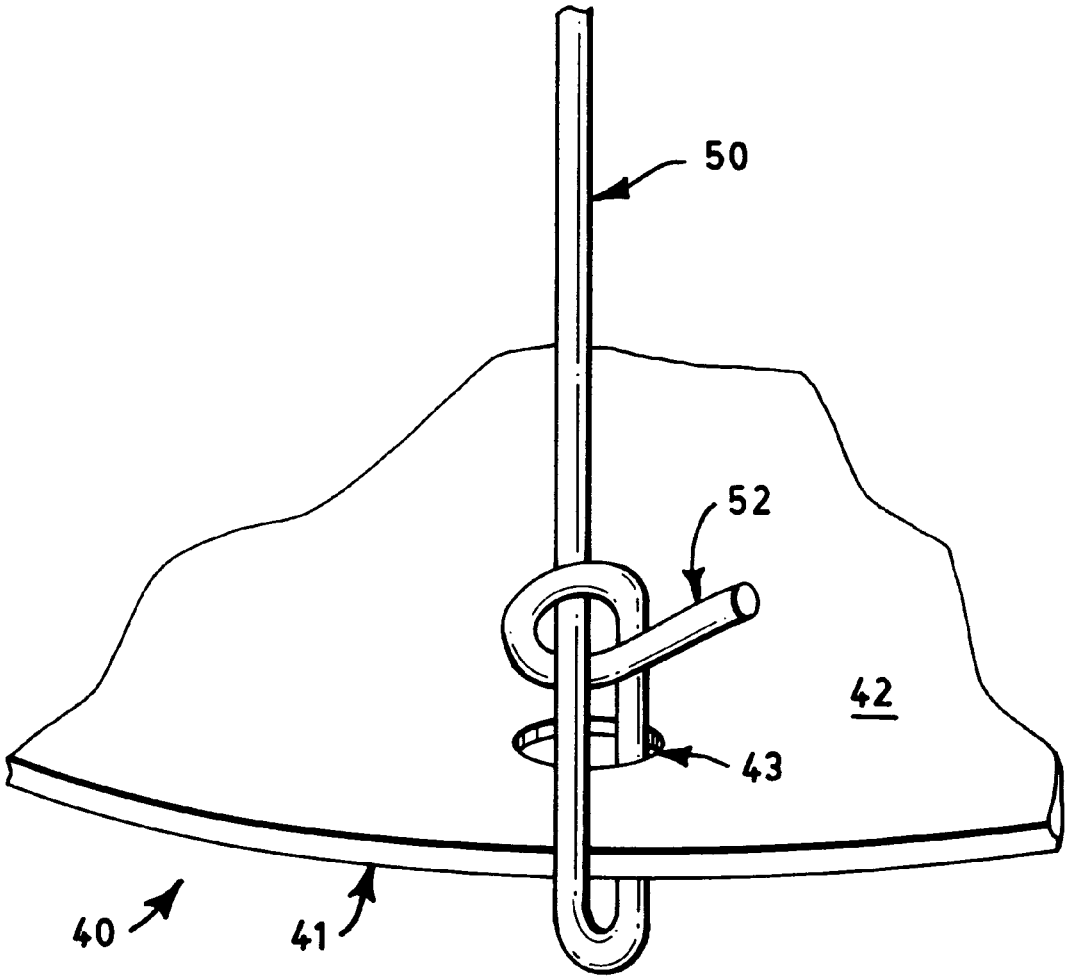
FIG. 4*a* is an enlarged perspective view of one element of FIG. 4 showing a preferred means of attaching flexible support members to a base according to a preferred embodiment of the present invention.
Figure 4B:
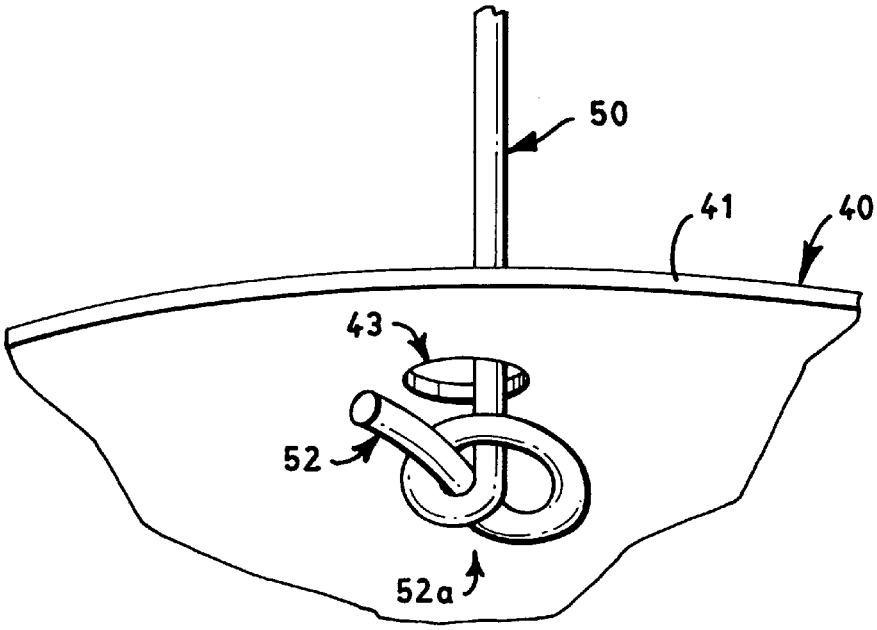
FIG. 4*b* is an enlarged perspective view of an alternative means of FIG. 4*a* for attaching flexible support members to a base according to the present invention.
Figure 4C:
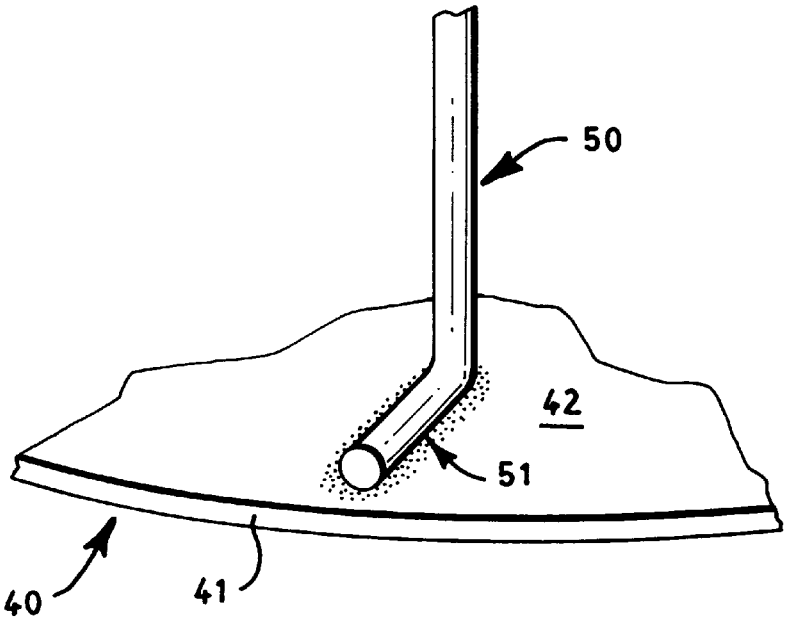
FIG. 4*c* is an enlarged perspective view of another alternative means of FIG. 4*a* for attaching flexible support members to a base according to the present invention; and, FIG. 5 is a perspective view of a container-holding device of the present invention attached to a rigid support.

With additional reference to FIG. 4*a,* a preferred means of attaching the flexible support members 50 to the base 40 is shown. In this embodiment, a small hole 43 is provided at a location towards an outer edge 41 of the base 40 to receive a flexible support member 50 therethrough. A second distal end 52 of each flexible support member 50 is inserted through its respective receiving hole 43, looped outwardly around the outer edge 41 of the base 40 and tied to a portion of itself opposite the hole 43. Alternatively, as shown in FIG. 4*b,* the second distal end 52 of each flexible support member 50 may be inserted through its respective receiving hole 43 and tied into a knot 52*a* entirely adjacent to an underside of the base 40. The knot 52*a* is sized larger than the hole 43 to prevent the second distal end 52 from sliding back through its respective hole 43. Alternatively still, as shown in FIG. 4*c,* the second distal end 52 of each flexible support member 50 may be adhered, such as, for example, by glue or other suitable adhesive, to the upper surface 42 of the base 40.

Returning to FIG. 2, the cooperating relation of the retaining ring 30, the base 40 and the flexible support members 50 defines a cup-shaped receiving pocket 60 sized to receive a typical container 11, shown in FIG. 1. With additional reference to FIG. 1, the retaining ring 30 includes an inner diameter $D_1$ which is greater than the outer diameter $D_2$ of a typical cylindrical container 11 received therein, thereby defining an annular space 80 between the outer diameter $D_2$ of the container 11 and the inner diameter $D_1$ of the retaining ring. The annular space 80 permits the container 11 to move within receiving pocket 60 and independently from the retaining ring 30. For example, in a preferred embodiment of the present invention, the container 11 includes an outer diameter $D_2$ of about four inches and the retaining ring 30 includes an inner diameter $D_1$ of about five inches. Thus, the container 11 is permitted to move relative to and independently from the retaining ring 30 about one-half inch in any radial direction. More particularly, the retaining ring 30 is permitted to move relative to the container 11 one-half inch in any radial direction before the inner surface 35 of the radial ring 30 contacts the container 11 and moves the container 11 therewith.

The flexible support members 50 include a length $L_2$ which is about two-thirds the height $L_1$ of a typical container 11. For example, in a preferred embodiment of the present invention, the container 11 has a height $L_1$ of about six inches and the flexible support members 50 have a length $L_2$ of about four inches.

In use, the container 11 is inserted into the receiving pocket 60, and is supported by the upper surface 42 of the base 40 and by the inner surface 35 of the retaining ring 30. The flexible support members 50 and the annular space 80 allow the container-holding device 10 to be subjected to sudden and significant changes in position and orientation without transferring such movement to the container 11.

With reference to FIG. 5, a container-holding device 10 of the present invention is shown attached to a riding saddle 12. A transverse strap receiving hole 70 is provided through the handle 20 towards the second distal end 23 thereof above the longitudinal central axis of the handle 20. A strap 90 is passed through the transverse strap receiving hole 70 and tied to an external, rigid support, such as a riding saddle 12 mounted on a horse (not shown). The strap 90 is then tightened sufficiently against the riding saddle 12 so that the handle 20 is drawn towards the riding saddle 12. It is to be understood that any number of a variety of ways mays be used to attach the container-holding device 10 to the saddle 12. Handle 20 is provided with a concave surface 24 at one end thereof which abuts the riding saddle 12, such as, for example, on the horn (not shown) of the saddle 12, cantilevering the handle 20 and receiving pocket 60 substantially therefrom. The placement of the transverse hole 70 above the longitudinal central axis of the handle 20 enhances the surface contact area between the concave surface 24 and the riding saddle 12, thereby discouraging overall "tipping" of the container-holding device 10 relative to the saddle 12.

The foregoing detailed description is given primarily for clearness and understanding and no unnecessary limitations are to be understood therefrom. Modifications will become obvious to those skilled in the art upon reading this disclosure and may be made without departing from the spirit or the scope of the present invention.

I claim:

1. A container-holding device, comprising:

a retaining ring having an outer surface;

a handle having a first distal end thereof attached to said retaining ring outer surface;

a plurality of flexible support members attached to and depending downwardly from said retaining ring;

a base attached to said flexible support members opposite said retaining ring;

wherein said handle further comprises a second distal end opposite said first distal end, said second distal end having a concave surface, said concave surface having a roughened portion provided thereon;

means for attaching said handle to a rigid support, said means for attaching said handle to said rigid support further comprises:

a transverse strap receiving hole extending through said handle at said second distal end above a longitudinal central axis thereof; and, a flexible strap received by and extending through said transverse strap receiving hole.

* * * * *